US006233749B1

(12) United States Patent
Sasaki et al.

(10) Patent No.: US 6,233,749 B1
(45) Date of Patent: May 22, 2001

(54) PORTABLE TOILET STOOL HAVING DEODORIZING AND AIR-CURTAINING EFFICIENCIES

(75) Inventors: Hideo Sasaki; Tetsuo Sakuma; Haruhiro Arisa; Atsumi Fujita, all of Ebina (JP)

(73) Assignee: Atsugi Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/443,153

(22) Filed: Nov. 16, 1999

(30) Foreign Application Priority Data

Jan. 18, 1999 (JP) ..... 11-046907
Apr. 6, 1999 (JP) ..... 11-099100
Jun. 8, 1999 (JP) ..... 11-160434

(51) Int. Cl.[7] ..... E03D 9/04; A47K 11/04
(52) U.S. Cl. ..... 4/213; 4/477; 4/482
(58) Field of Search ..... 4/213, 477, 482, 4/472, 475

(56) References Cited

U.S. PATENT DOCUMENTS 1,150,862 * 8/1915 Hardin ..... 4/477
1,248,901 * 12/1917 Pavlik, Jr. ..... 4/482
1,250,701 * 12/1917 Dixon et al. ..... 4/477
1,264,793 * 4/1918 Heniger ..... 4/477
1,270,409 * 6/1918 Haas ..... 4/477
1,343,287 * 6/1920 Shafer ..... 4/477
2,110,956 * 3/1938 Horbetz ..... 4/477
5,454,122 * 10/1995 Bergeron ..... 4/213

FOREIGN PATENT DOCUMENTS

223361 * 10/1924 (GB) ..... 4/482
3-191126 * 8/1991 (JP) ..... 4/213

* cited by examiner

*Primary Examiner*—Charles R. Eloshway
(74) *Attorney, Agent, or Firm*—Shlesinger, Arkwright & Garvey LLP

(57) ABSTRACT

A portable toilet stool or bowl, upper opening of which is effectively closed by an air-curtain formed by currents of air flowing all over said opening, so that the smell of feces evacuated into the stool does not freely rise into the air from the upper opening, and the smell is forcibly subjected within the stool, to deodorizing and/or decomposition, and discharged into the air or circulated within the stool for a predetermined period of time.

16 Claims, 12 Drawing Sheets

PORTABLE TOILET STOOL HAVING DEODORIZING AND AIR-CURTAINING EFFICIENCIES

BACKGROUND OF THE INVENTION

This invention relates to a portable toilet stool or bowl which can arrest within the stool the smell of feces discharged into the stool and which can effectively deodorize them.

Old people who grow physically weak while they are mentally normal and can intend to evacuate, physically handicapped people, and patients suffering from diseases or accidents, can hardly go to the toilet, and are compelled to use a portable stool or bowl beside their beds.

Since this kind of portable stools are used just beside beds, they are generally simple and bucket-shaped. Accordingly, the smell of feces discharged into such bucket-shaped stool displeases persons who work to dispose of them. It displeases other patients and attendants too. Those people and patients who are compelled to use stools of such simple structures, feel mentally painful, by themselves. Since stools in which feces were discharged, can hardly be cleaned in no time, on account of shortage of hands today, such displeasure and pain become worse.

Therefore, in order to lessen the smell of feces, a stool is sometimes filled with water about half, and they are dropped into the water. This can not, however, shut off completely the smell of feces, but this makes the stool heavy, resulting in making it more laborious to handle the stool.

Lately, bucket-shaped stools in which deodorizers are installed, and other stools having structures by which the smell of feces can partially be sucked, have been in the market. Although such stools are a little effective for reducing the smell when they are being used, as buttocks are located above the upper opening of stools so as to close it, they are ineffective, because the smell evaporates from the upper opening and escapes outside, whereby it can not be deodorized.

In view of the above, it is an object of this invention to provide a portable stool which can shut off the smell of feces within the stool when it is used and even after it has been used, so that it can not escape outside, but can effectively be deodorized.

SUMMARY OF THE INVENTION

In this invention, its portable stool is designed to have an air-curtain which cover all over the upper opening by air flows. In order to produce such air flows, one or plural air-suction openings are provided adjacently to the upper opening of the stool, and air is forcibly sucked into the air-suction openings by a suction fan so that the air-curtain can prevail over the upper opening of the stool.

The air is sucked with the smell into an air passage or passages connected to the air suction openings, is decomposed by an ozonizer located in the air passages, deodorized when it is passed through adsorption layers filled with adsorbents such as activated carbon and the like, and discharged from an exhaust opening as an odorless air.

THE DRAWINGS

Figure 1:
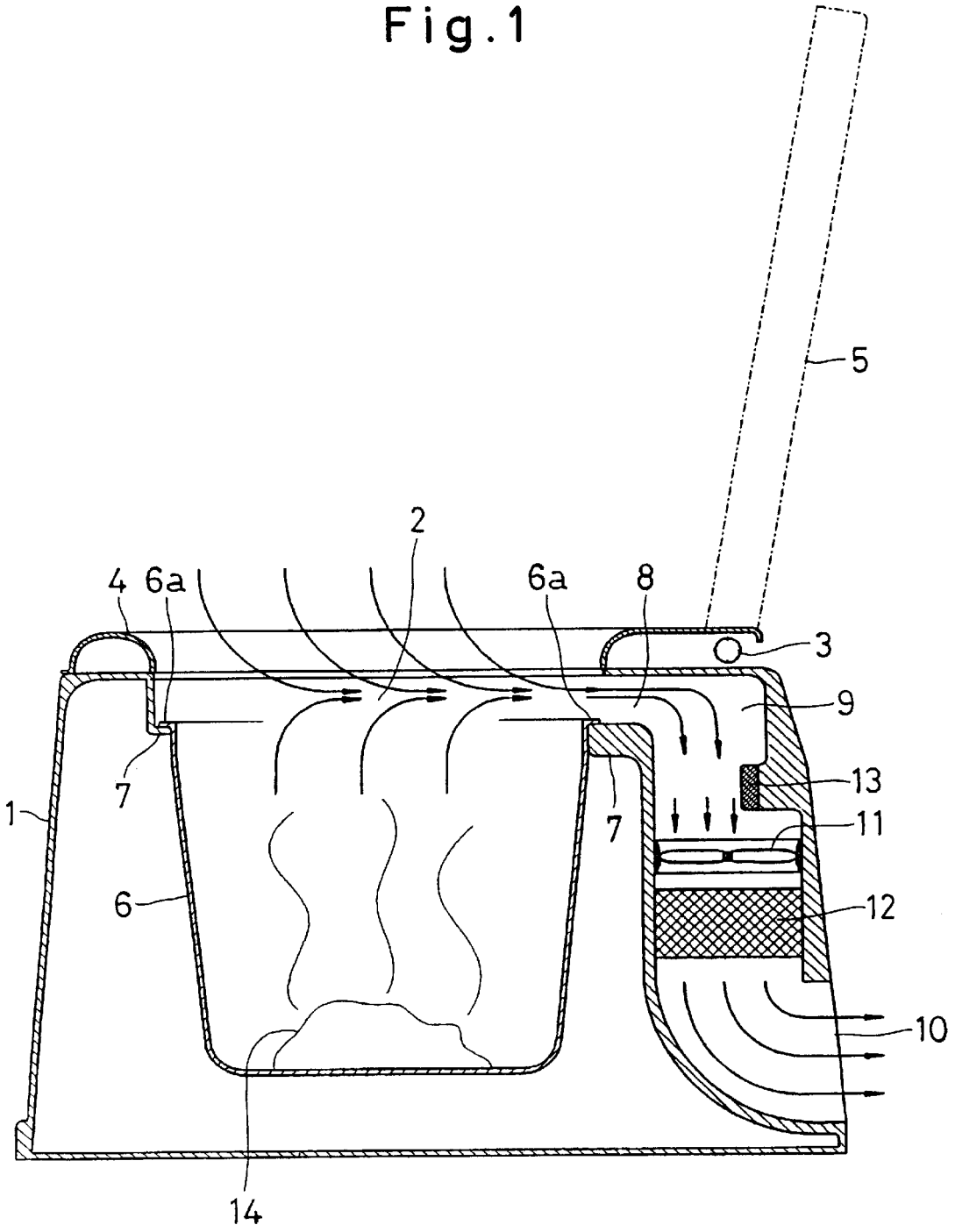
Figure 2:
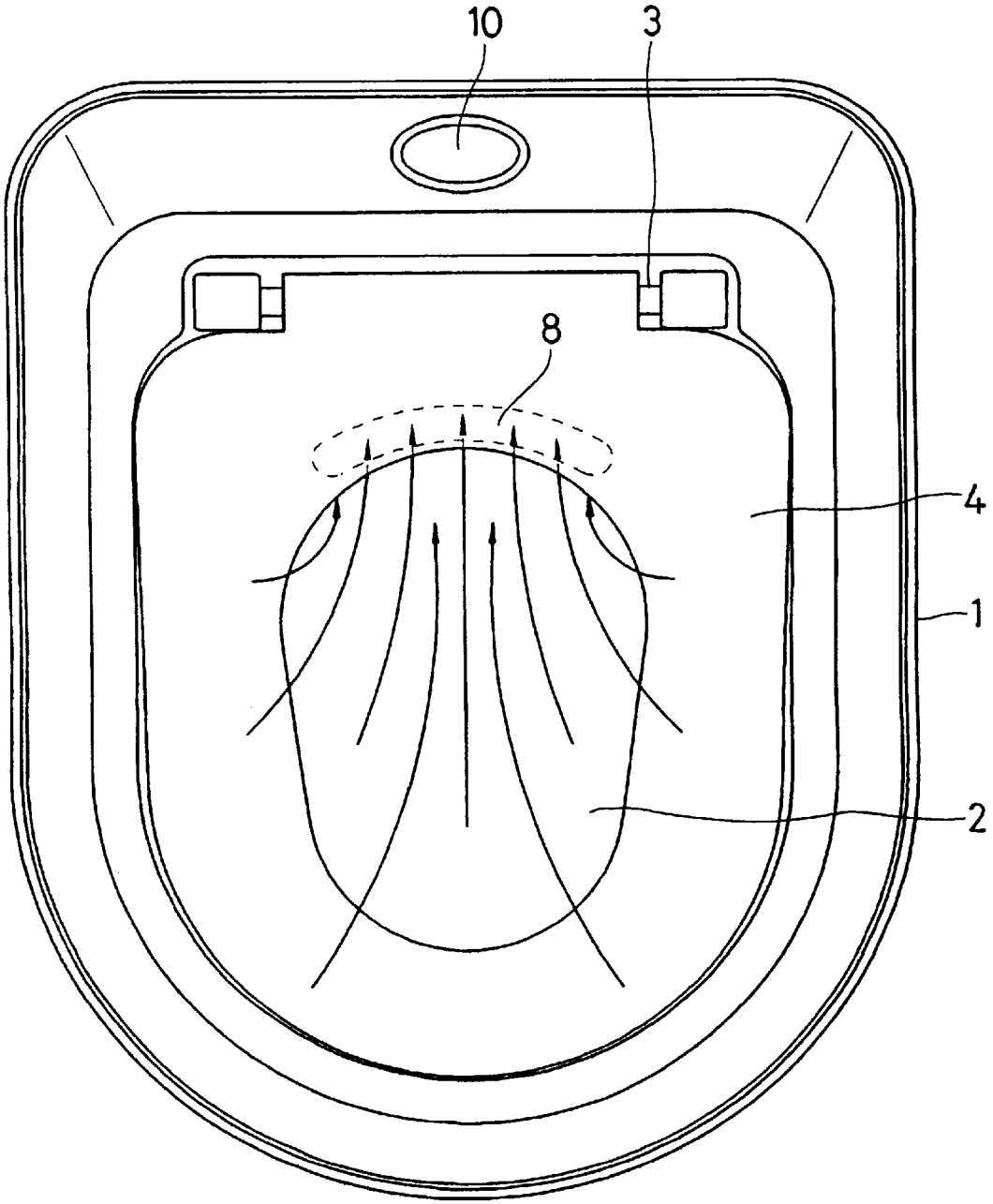
Figure 3:
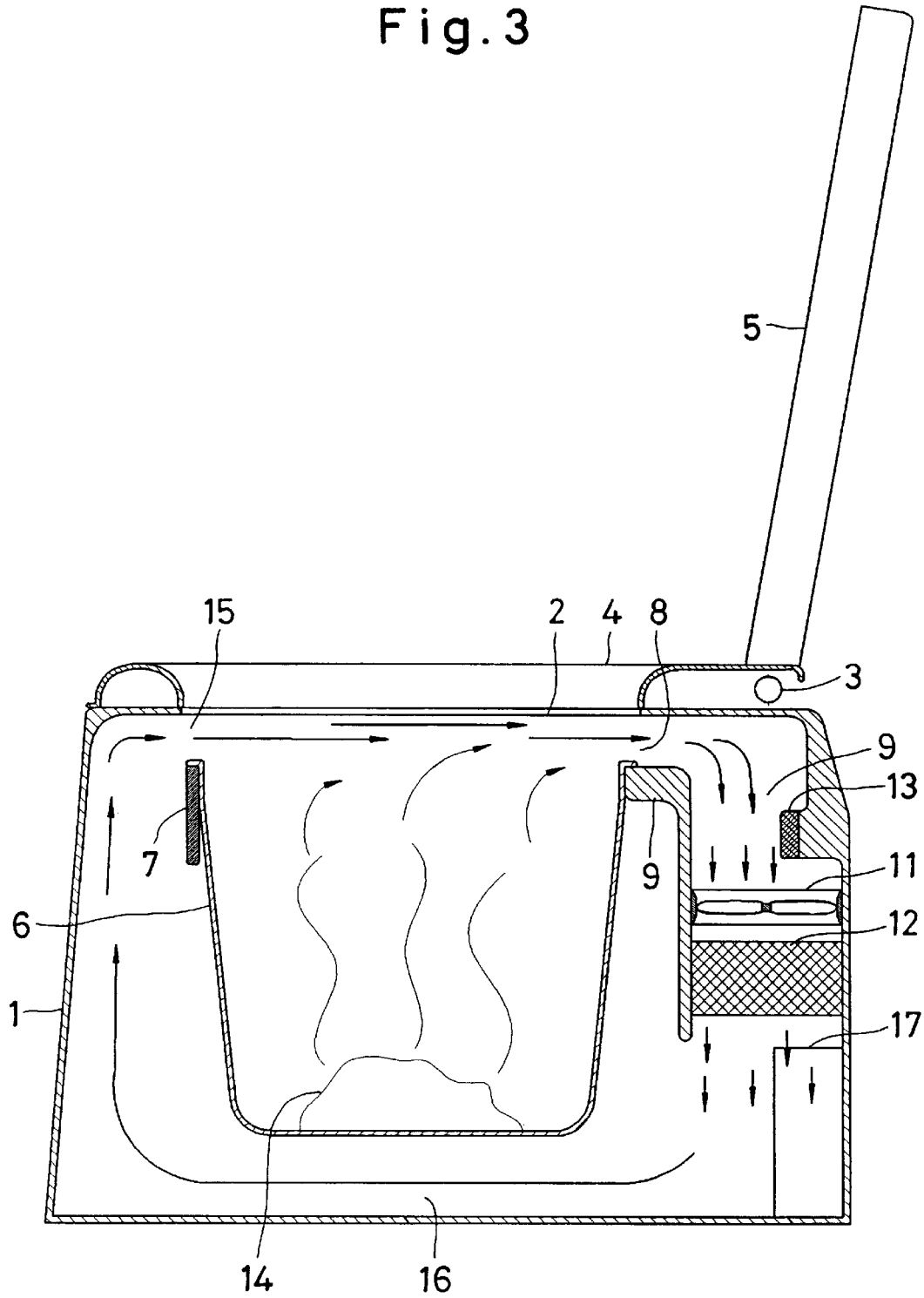
Figure 4:
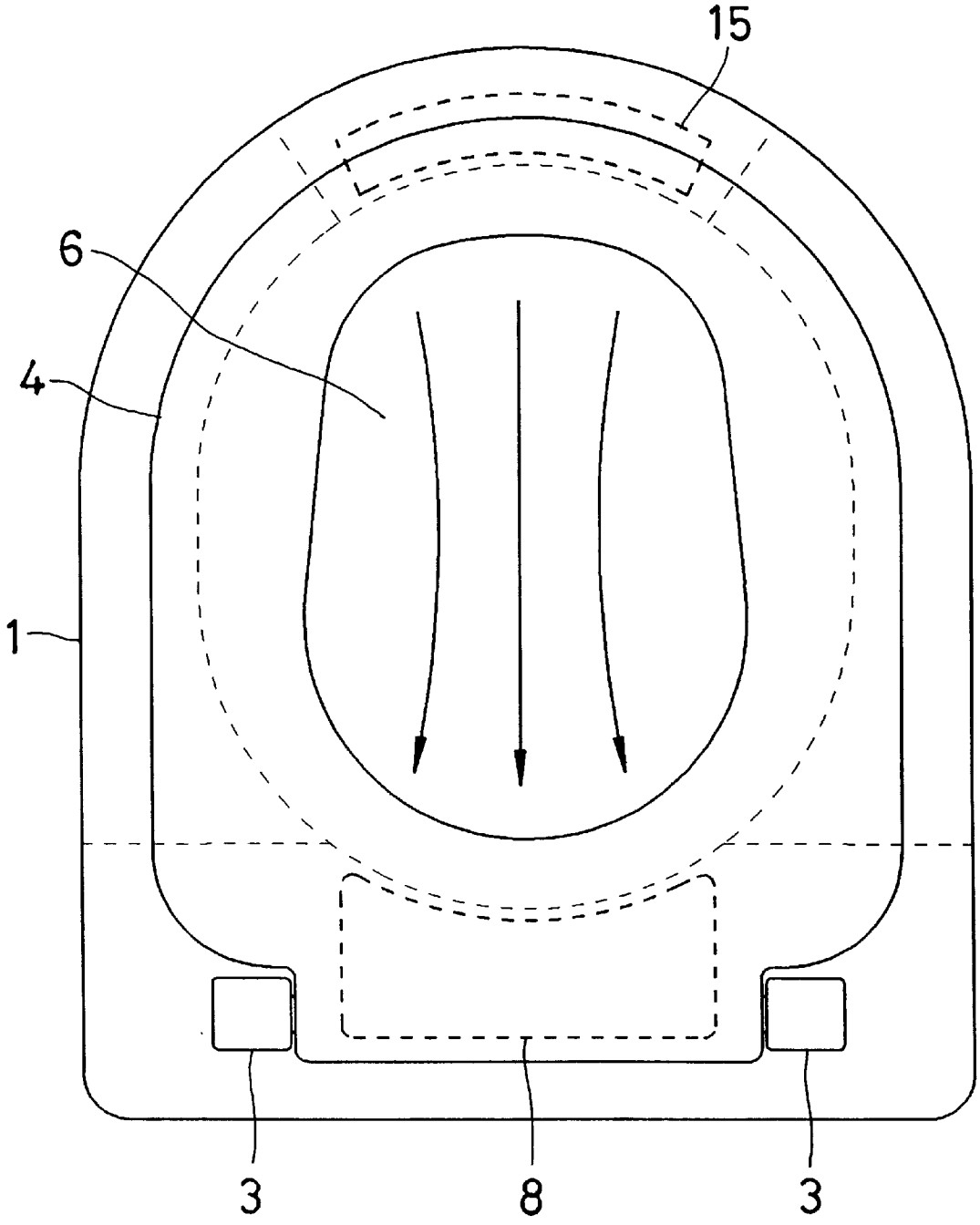
Figure 5:
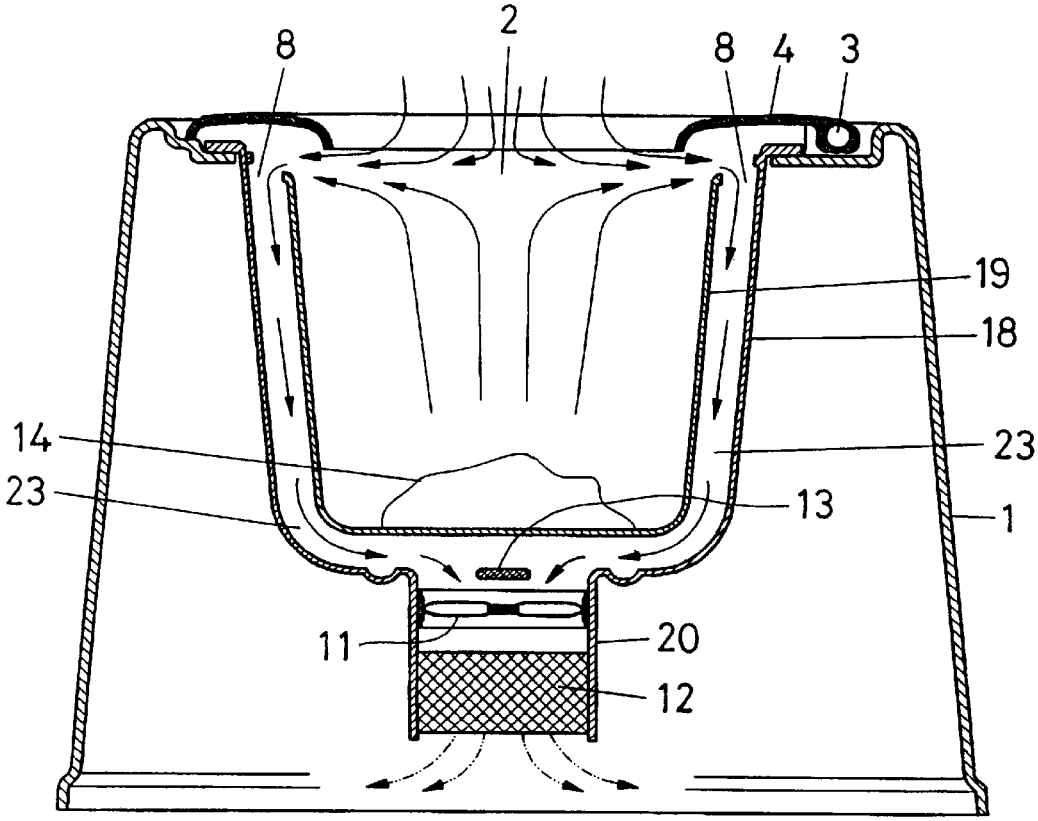
Figure 6:
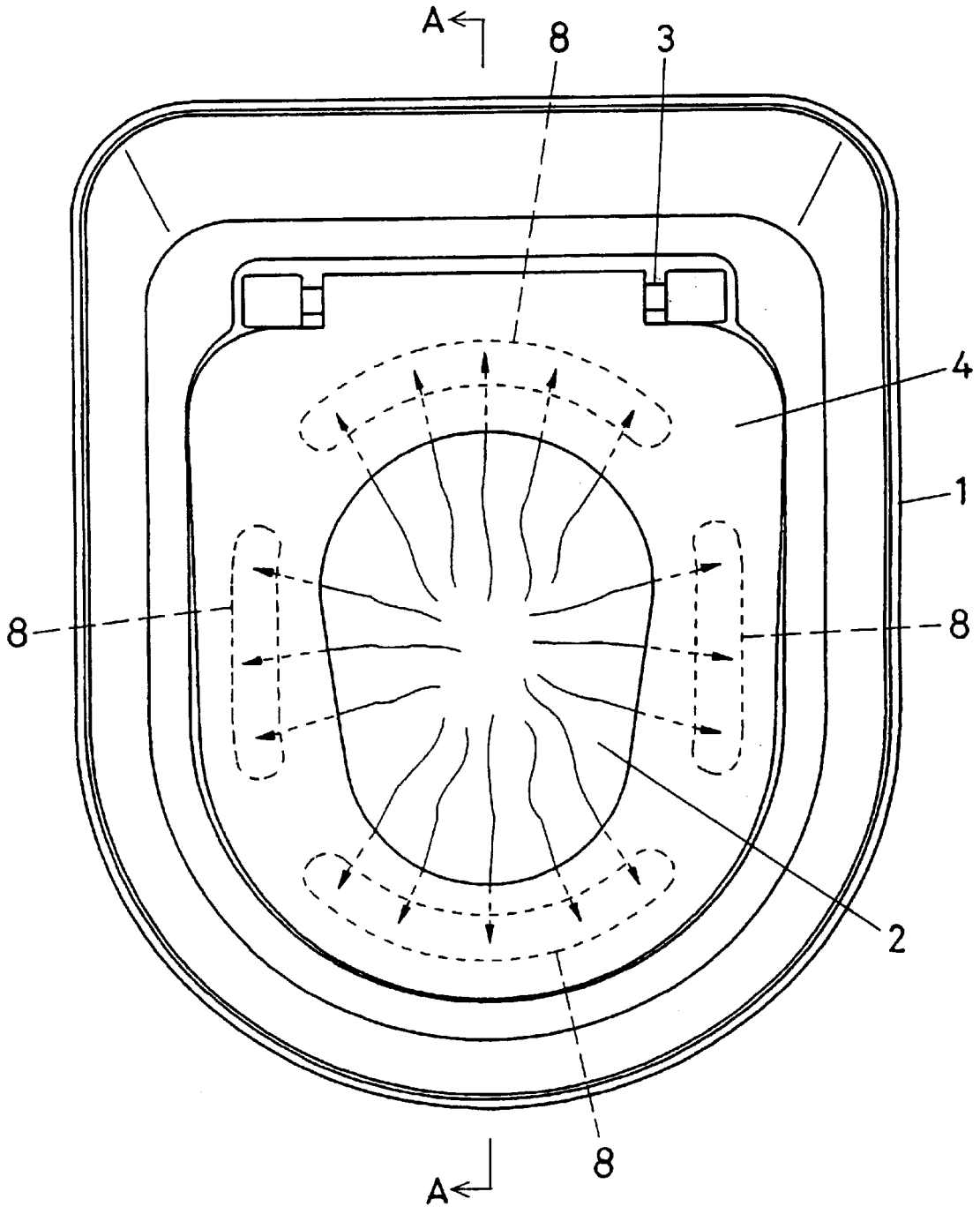
Figure 7:
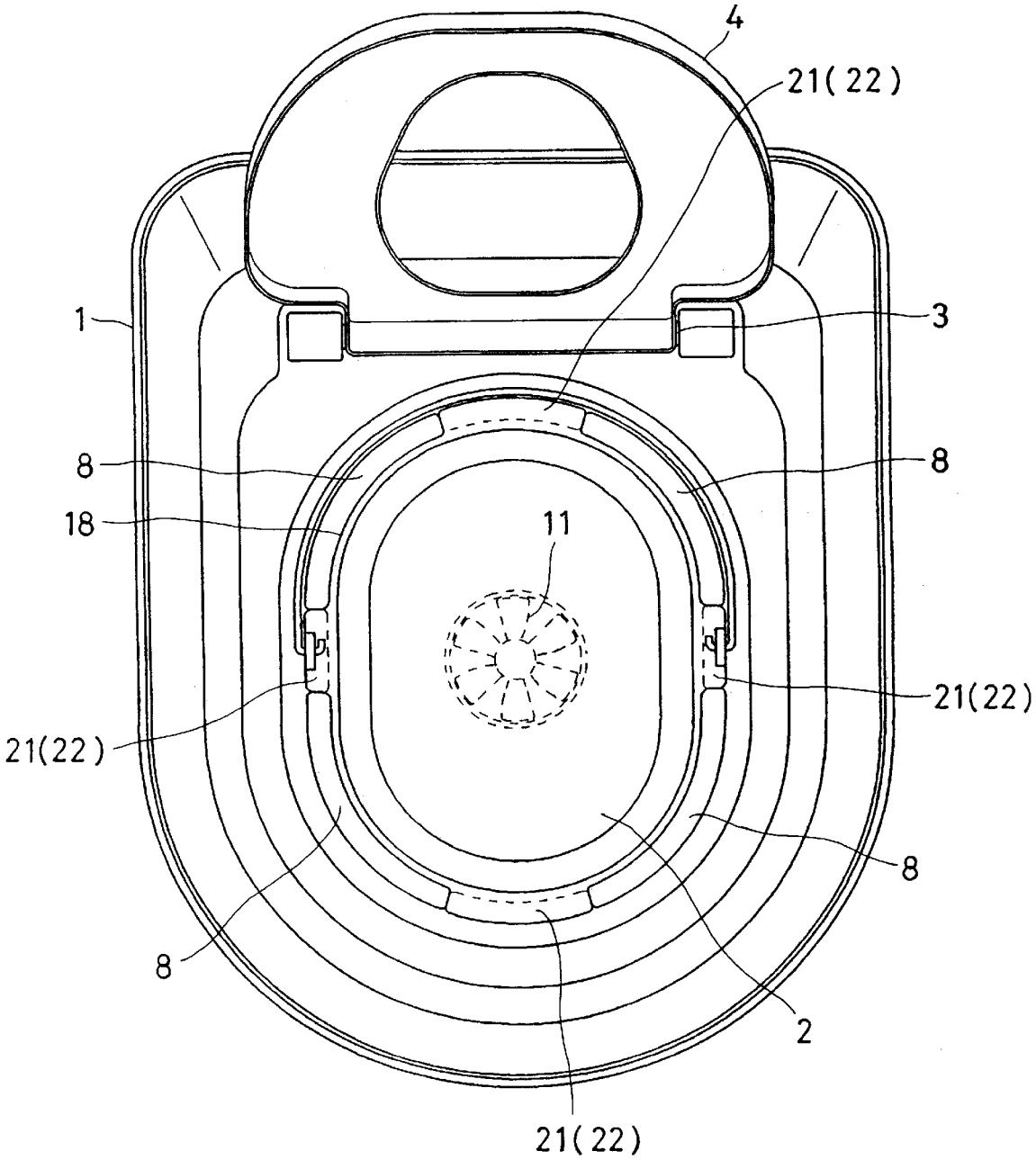
Figure 8:
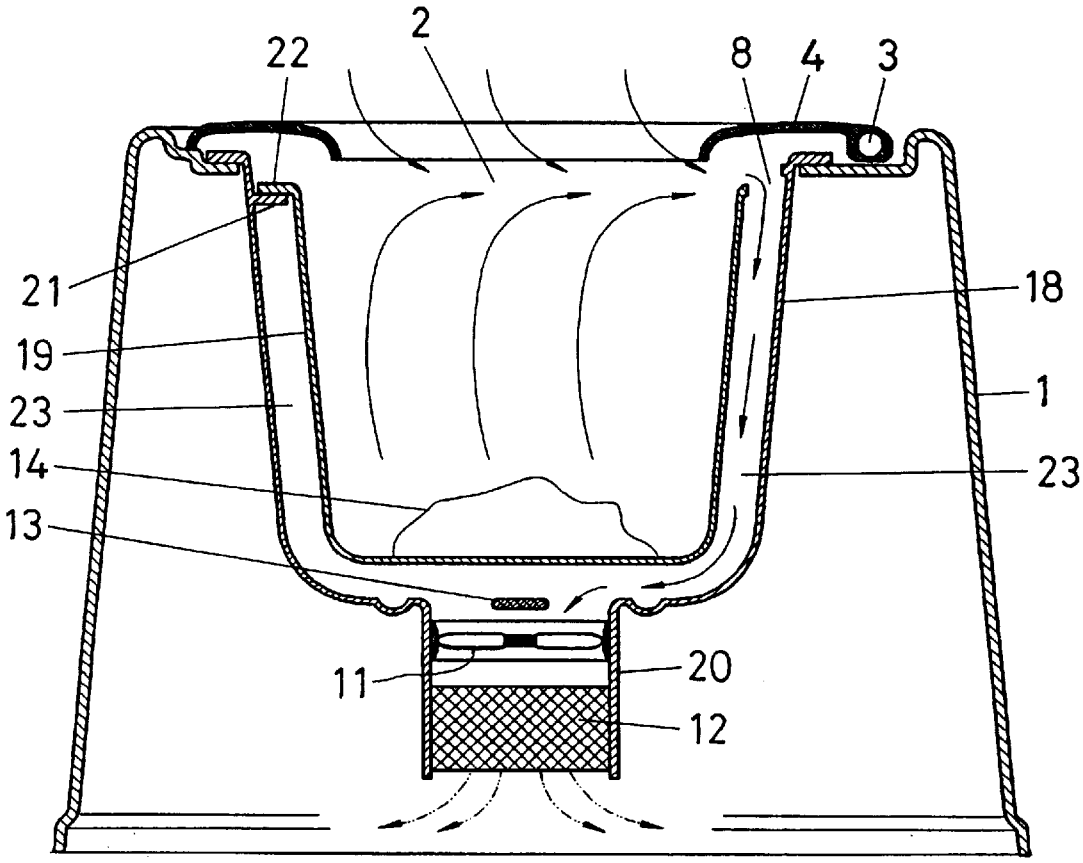
Figure 9:
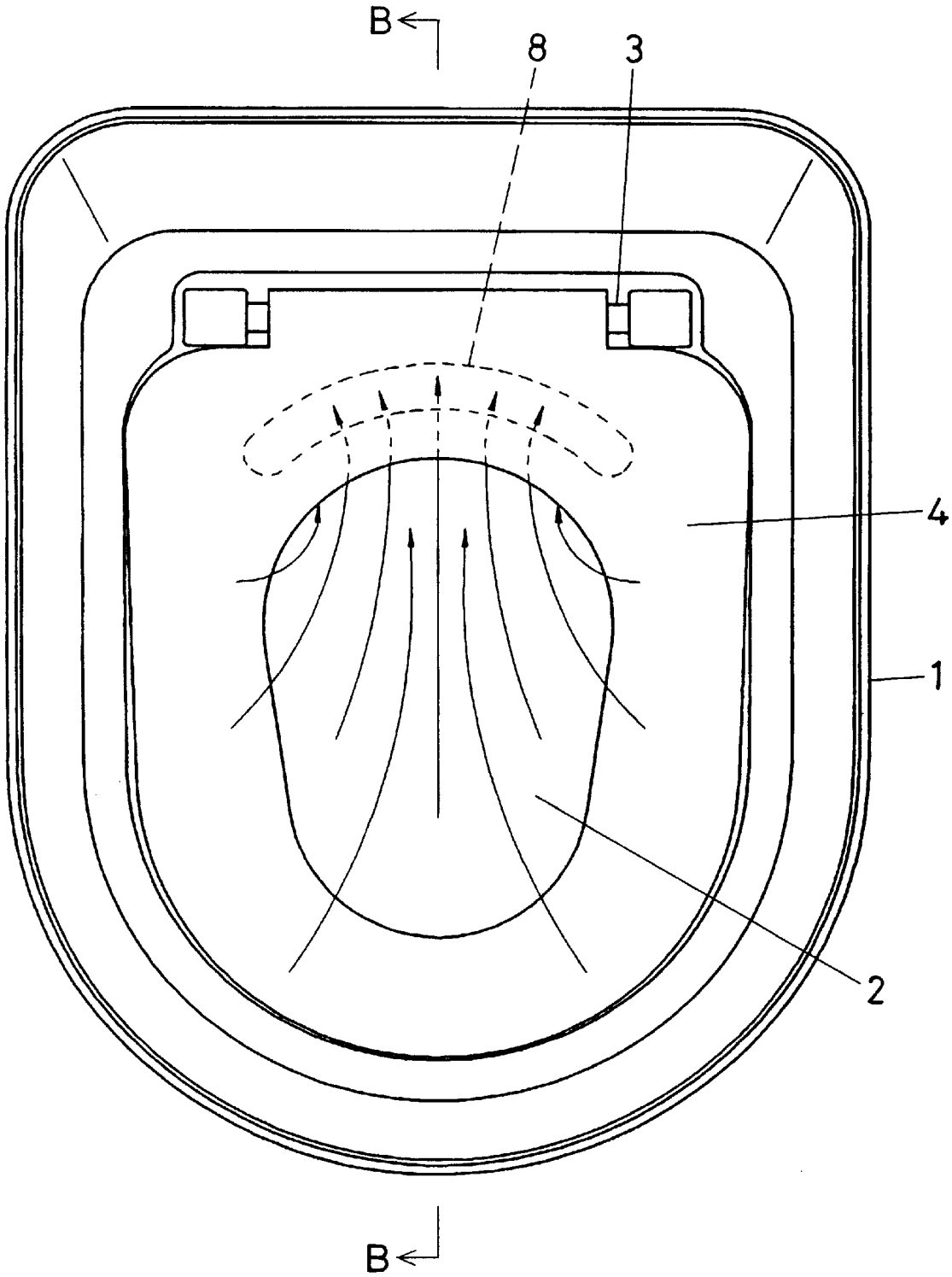
Figure 10:
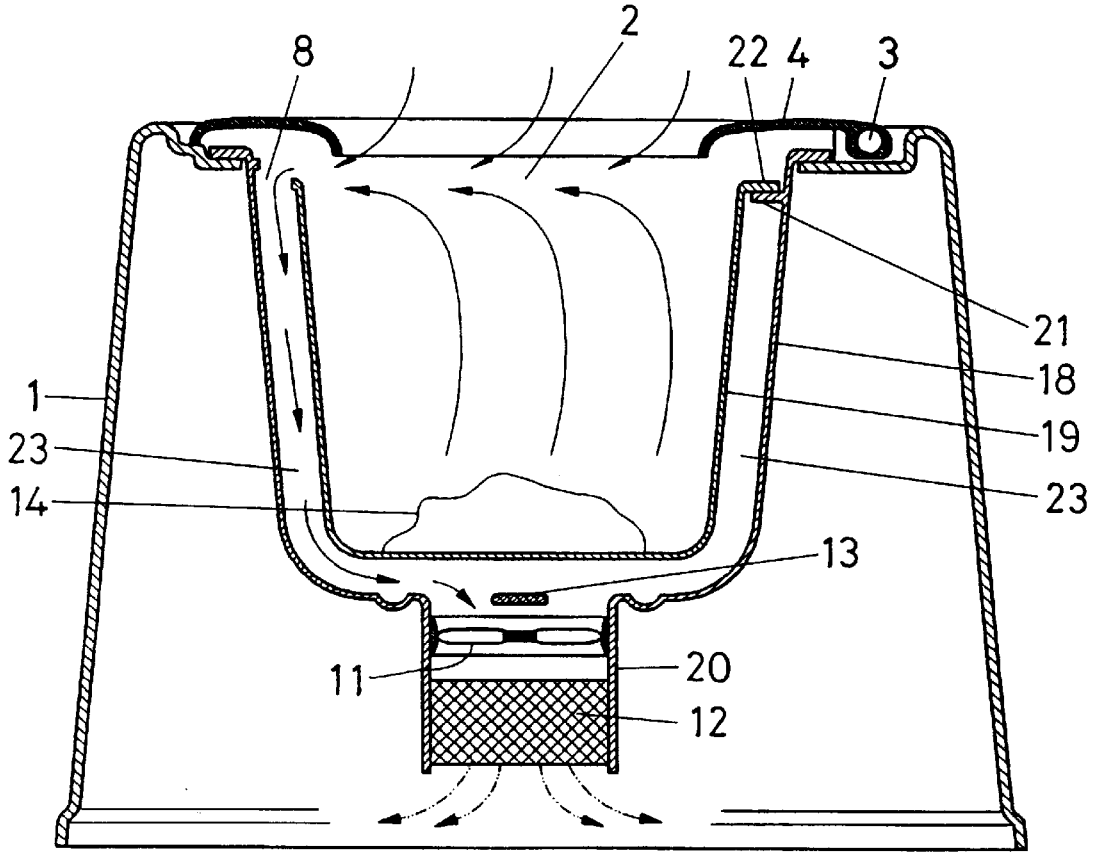
Figure 11:
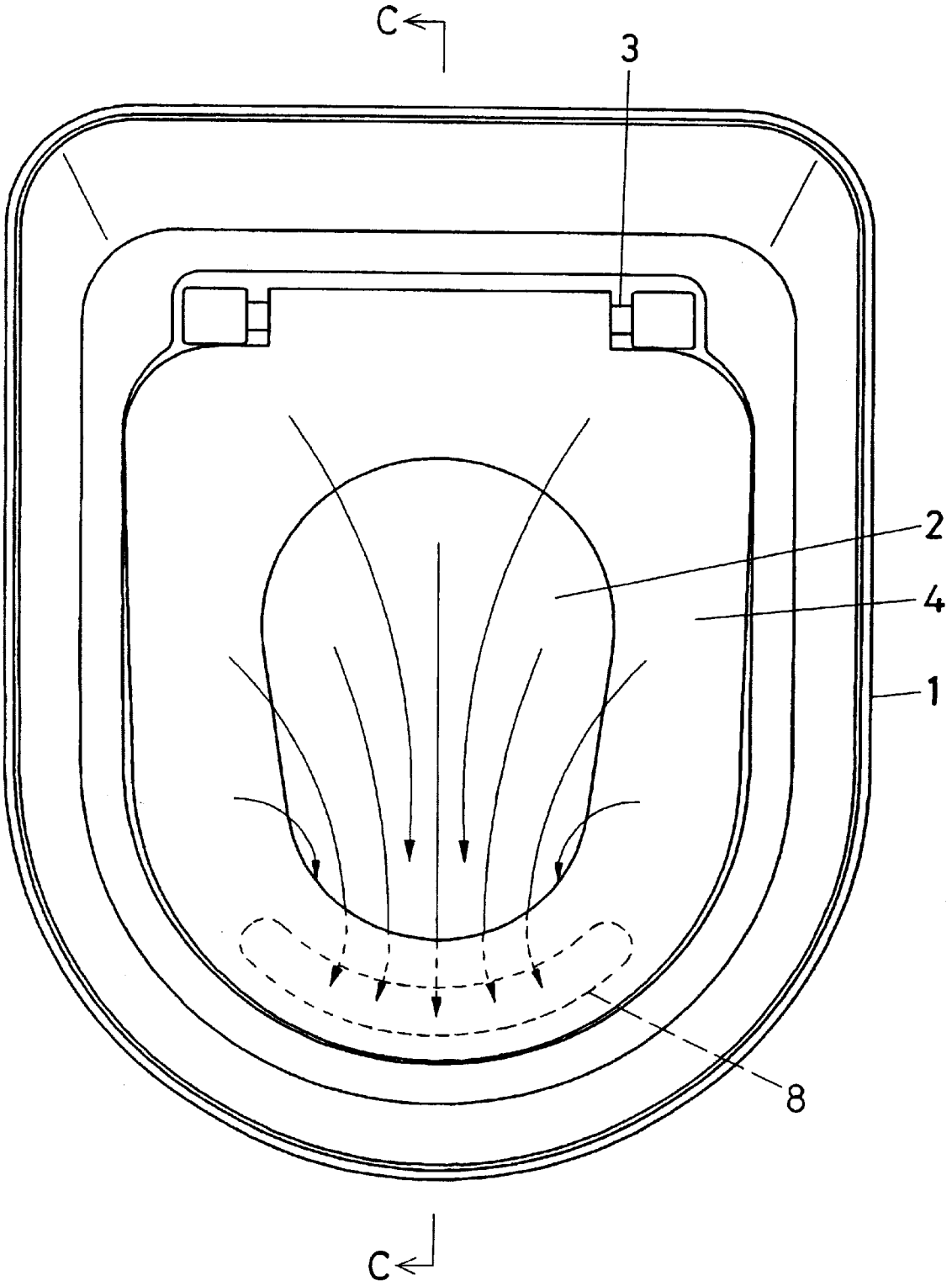
Figure 12:
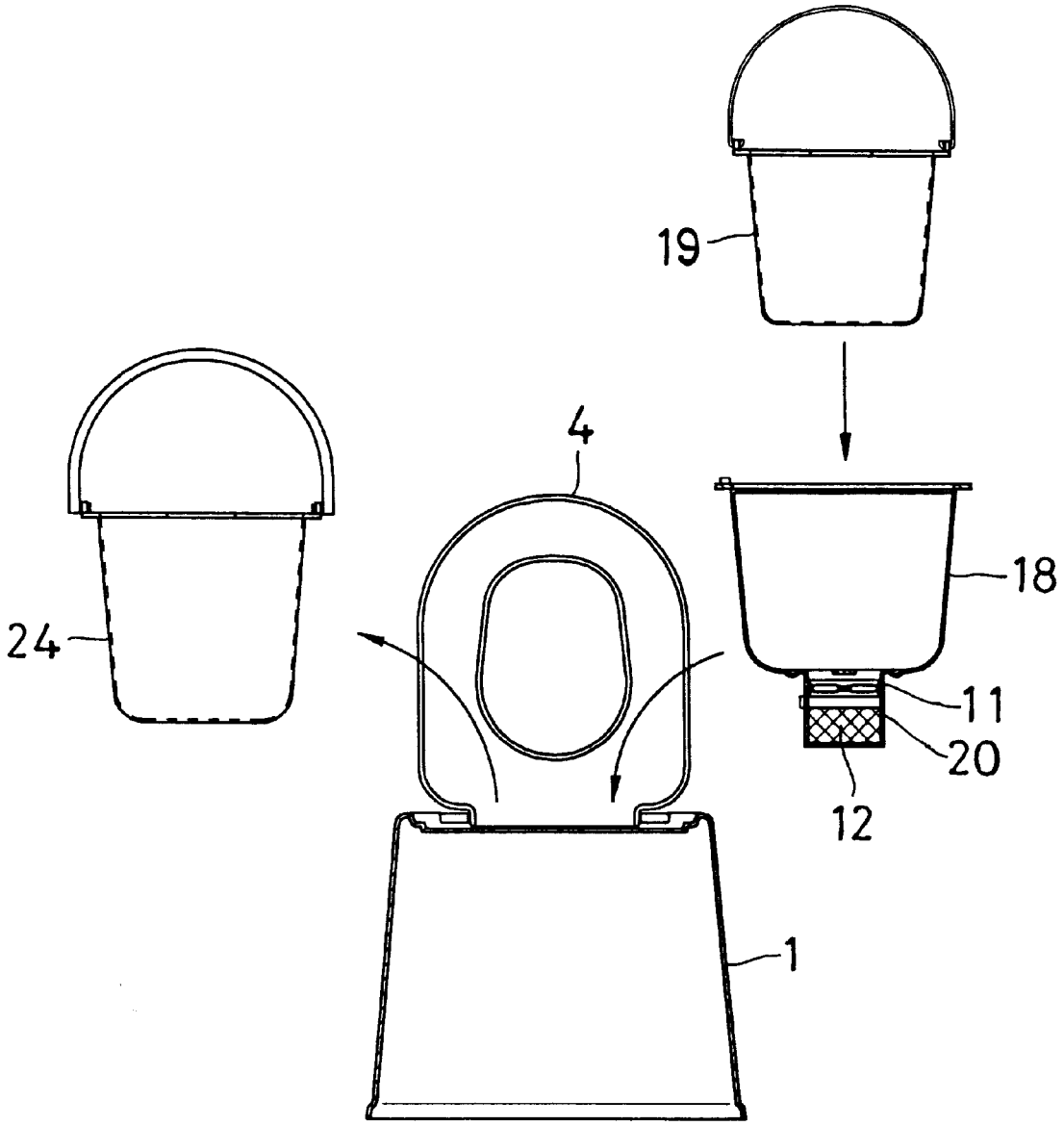

FIG. 1 is an explanatory sectional side view of an embodiment of the portable stool made in accordance with this invention, and having deodorizing and air-curtaining efficiencies, FIG. 2 is a plan view of the stool shown in FIG. 1, FIG. 3 is an explanatory sectional side view of other embodiment of the portable stool having deodorizing and air-curtaining efficiencies, FIG. 4 is an explanatory plan view of FIG. 3, FIG. 5 is an explanatory sectional side view cut along the line A—A in FIG. 6, of a further other example of the portable stool of this invention having deodorizing and air-curtaining efficiencies and provided with a double-bottom bucket or a pair of buckets, FIG. 6 is a plan view of the portable stool shown by FIG. 5, in which a seat closes the upper opening of stool, FIG. 7 is a plan view similar to FIG. 6, but the seat is lifted up, FIG. 8 is an explanatory sectional side view of other embodiment of the portable stool cut along the line B—B in FIG. 9, which is provided with a double-bottom bucket or a pair of buckets, and in which the air-suction opening is located only at the rear side of the upper opening, FIG. 9 is a plan view of the portable stool shown by FIG. 8, FIG. 10 is an explanatory sectional side view of further other embodiment of the portable stool of this invention cut along the line C—C in FIG. 11, which is provided with a double-bottom bucket or a pair of buckets, and in which the air-suction opening is located only at the front side of the upper opening, FIG. 11 is a plan view of the portable stool shown in FIG. 10, and FIG. 12 is an explanatory front view of a stool, a conventional bucket installed in the stool, and the air of buckets of this invention which are to installed in the stool in place of the conventional bucket.

DETAILED DESCRIPTION OF THE PREFERRED EMBODIMENTS

With reference to FIGS. 1 and 2 which show an embodiment of the portable stool made in accordance with this invention, a stool body 1 as a whole, has a vertically erected tubular shape which is provided at its upper surface with an oval opening 2. On the upper surface of the stool body 1 and adjacently to a rear end of the transverse axis of the oval opening 2, there is fixed a hinge 3 about which a seat 3 and lid 5 are fitted so that they can be freely erected or brought down over the oval opening.

A bucket 6 which receives therein feces is removably fitted into the stool body so that its upper opening lies under the oval opening 2 of the stool body. As outwardly extending upper flanges 6*a* of the bucket 6 are hung over a support ridge 7 which locates below the upper surface of the stool body, there is produced a horizontally extending narrow space between the upper opening of the bucket and the oval opening of the stool body. Numeral 8 indicates a horizontally extending narrow air-suction opening which is provided to the stool body adjacently to the rear end of the transverse axis of the oval opening 2, and which connects to an air-suction passage 9 partitioned within the stool body 1 and to an exhaust opening 10 located at a lower side of the stool body. An electric suction fan 11 which is fitted intermediately in the air-suction passage 9, has a strong suction force so as to produce an air-curtain which can prevail completely over the upper oval opening 2 of the stool body 1. An ozonizer 13 is located above the suction fan 11, while below the suction fan there is installed adsorption layers 12 such as a replaceable cartridge filled with activated carbon and the like. Although FIGS. 1 and 2 do not illustrate, the air-suction fan 11 and ozonizer 13 are operated by an outer electric source through an on/off operation of a switch. When a person seats on the seat 4 of the stool, they may be operated automatically in response to his weight, and they may be kept operated for a while even after the person had left the stool.

The portable stool having the above-mentioned structures operates as follows.

When a person brings down the seat 4 and sits down on it for the evacuation, the fan 11 and ozonizer 13 operate. Then, as the upper oval opening 2 of the stool is closed by his buttocks, there is produced a compulsory current of air, whereby the air within the bucket 6 is sucked by the air-suction opening 8, passed through the air passage 9, and discharged outside from the lower exhaust opening 10. Thus, the smell of feces 14 discharged in the bucket is forcibly led into the air passage 9 where it is decomposed by ozone of the ozonizer 13 and succeedingly deodorized by the adsorption layers 12. And, as the fan 11 and ozonizer 13 continue to operate even after the person had left stool, the aforementioned air-curtain produced by the fan completely shuts off the smell from the outside. The feces 14 left in the bucket 6 may easily be disposed of, as the bucket is simply suspended within the stool body and can readily be taken out from the stool body.

In the other embodiment of the portable stool made in accordance with this invention and illustrated in FIGS. 3 and 4, the compulsory current of air which forms the air-curtain over the oval opening of the stool, is continuously circulated through the stool. In FIGS. 3 and 4, numeral 15 indicates a horizontally extending narrow air-blowing opening which is located at the opposite side of and at the same height of the air-suction opening 8. In this instance, air in a space between the user's buttocks and the upper opening of bucket 6, is sucked by the fan 11 into the passage 9 via the air-suction opening 8, subjected to the ozonizer 13 and the adsorption layers 12 whereby it is decomposed and deodorized, passed through an air-discharge passage 16 formed between the inner bottom of the stool body and the outer bottom of the bucket 6, carried toward the air-blowing opening 15, and blown all over the bucket as long and narrow currents of air. These currents form an air-curtain which shut off the upper opening of the bucket from the outside. As the currents absorb the smell of feces 14, it is decomposed and deodorized while the currents of air circulate within the stool.

In FIG. 3, numeral 17 indicates a controller fitted at a corner within the stool body, which is electrically connected at one end to an electric source and at another end to the fan 11 and ozonizer 13, so that when the lid 5 is open or when a person sits down on the seat 4, the fan and ozonizer operate while the stool is used and for a predetermined additional period of time after the person had left stool.

In FIGS. 5 to 7, there is shown further other embodiment of this invention. In this embodiment, a deodorizing outer bucket 18 is removably fitted into the stool through its upper opening and by means of engagement projections 21 (as best shown in FIGS. 8 and 10), while in turn, an inner bucket 19 for receiving feces which is a little smaller than the deodorizing outer bucket 18 is removably fitted into the deodorizing outer bucket 18 by means of engagement projections 22 (as best shown in FIGS. 8 and 10). A cylindrical air passage 23 is formed between the two buckets, open at its upper end with the air-suction opening 8, and connected at its bottom to an air-discharge tubular opening 20 provided at the bottom of the deodorizing outer bucket. The discharge opening is, similarly to the other embodiments of this invention, fitted with the air-suction electrical fan 11, means 12 for deodorizing the smell of feces, and/or means 13 for decomposing the smell.

In the embodiment shown in FIGS. 5 to 7, as best shown in FIG. 6, the air-suction openings 8 are provided at upper four corners of the stool, while in the embodiment illustrated in FIGS. 8 and 9, only a single air-suction opening 8 is provided at a rear upper corner of the stool, as best shown in FIG. 9, whereby an air-curtain is formed by currents of air covering all over the upper opening 2 of the stool and flowing toward the rear corner, resulting in preventing the smell to leak outside.

As shown in FIGS. 10 and 11, a single air-suction opening may be provided only at the front corner of the stool, so that the air-curtain covering the upper opening 2 may flow toward the front corner. Likewise, the air-suction opening may be provided at the rear and front corners, or at the left and right corners.

As shown in FIG. 12, if a conventional bucket 24 is replaced by the buckets 18 and 19 of this invention, a conventional toilet stool can be modified to the one having deodorizing and air-curtaining efficiencies.

What is claimed is:

1. A portable stool, comprising:

a) a stool body having a top opening for receiving waste therethrough;

b) a first bucket disposed within said body;

c) a removable second bucket for receiving said waste and disposed within said first bucket with a space therebetween to create an air passage, said second bucket having an opening disposed below said top opening;

d) said passage having at least one air inlet disposed near said top opening and an outlet disposed through the bottom of said first bucket; and e) an air suction fan to draw air through said air inlet to said outlet to form an air curtain near said top opening.

2. A portable stool as in claim 1, and further comprising means for deodorizing the air flowing through said passage.

3. A portable stool as in claim 1, and further comprising means for decomposing the air flowing through said passage.

4. A portable stool as in claim 1, and further comprising an adsorption layer disposed in series with said air suction fan.

5. A portable stool as in claim 4, wherein said adsorption layer includes activated carbon.

6. A portable stool as in claim 4, wherein said adsorption layer is disposed downstream of said air suction fan.

7. A portable stool as in claim 1, and further comprising an ozonizer to decompose the air flowing through said passage.

8. A portable stool as in claim 7, wherein said ozonizer is disposed upstream of said air suction fan.

9. A portable stool as in claim 1, wherein:

a) said top opening includes front, rear, left and right sides; and b) said at least one air inlet is disposed adjacent said front side.

10. A portable stool as in claim 1, wherein:

a) said top opening includes front, rear, left and right sides; and b) said at least one air inlet is disposed adjacent said rear side.

11. A portable stool as in claim 1, wherein:

a) said top opening includes front, rear, left and right sides;

b) one air inlet is disposed adjacent said front side; and c) another air inlet is disposed adjacent said rear side.

12. A portable stool as in claim 1, wherein:

a) said top opening includes front, rear, left and right sides;

b) one air inlet is disposed adjacent said left side; and c) another air inlet is disposed adjacent said right side.

13. A portable stool as in claim 1, wherein said at least one air inlet is a narrow horizontally extending opening.

14. A portable stool as in claim 1, and further comprising a seat and a lid movably pivoted to said stool body.

15. A portable stool as in claim 1, wherein said air suction fan is carried by said first bucket.

16. A portable stool as in claim 1, wherein said first bucket is removable.

* * * * *